United States Patent [19]

Whittington et al.

[11] Patent Number: 4,898,354

[45] Date of Patent: Feb. 6, 1990

[54] PEG BOARD DISPLAY BRACKETS

[75] Inventors: Paul S. Whittington, Thornhill; James Morison, Oshawa, both of Canada

[73] Assignee: Gorrie Advertising Management Limited, Mississauga, Canada

[21] Appl. No.: 293,421

[22] Filed: Jan. 4, 1989

Related U.S. Application Data

[63] Continuation-in-part of Ser. No. 191,537, May 9, 1988, Pat. No. 4,817,900.

[51] Int. Cl.[4] ..... F16B 5/06

[52] U.S. Cl. ..... 248/225.1; 211/88; 211/175; 248/223.4; 248/224.4; 248/201

[58] Field of Search ..... 248/225.1, 227, 235, 248/239, 250, 201, 220.2, 223.4, 224.4; 211/175, 87, 59.2, 55, 88, 184; 108/109, 152

[56] References Cited

U.S. PATENT DOCUMENTS

| | | | |
|---|---|---|---|
| 2,940,603 | 6/1960 | Riedmaier et al. | 248/250 X |
| 3,185,426 | 5/1965 | Bjerke | 248/250 |
| 4,039,136 | 8/1977 | DeHart | 248/227 X |
| 4,376,521 | 3/1983 | Walters | 248/235 X |
| 4,632,256 | 12/1986 | Gambello | 211/175 X |
| 4,817,900 | 4/1989 | Whittington et al. | 248/225.1 |

FOREIGN PATENT DOCUMENTS

| | | |
|---|---|---|
| 0730981 | 3/1966 | Canada . |
| 1055436 | 5/1979 | Canada . |
| 1199900 | 1/1986 | Canada . |
| 1228838 | 11/1987 | Canada . |

*Primary Examiner*—Ramon O. Ramirez
*Attorney, Agent, or Firm*—Nixon & Vanderhye

[57] ABSTRACT

A bracket is disclosed for supporting a product on a display board having a number of regularly spaced passages defined therein, comprising a body with a surface to carry the product, the body having a support assembly integrally formed therewith to support the surface in position against the display board; and a first anchor portion for removable connection with the support assembly and including at least one hook element which is dimensioned to engage at least one of said passages.

8 Claims, 3 Drawing Sheets

FIG. 2
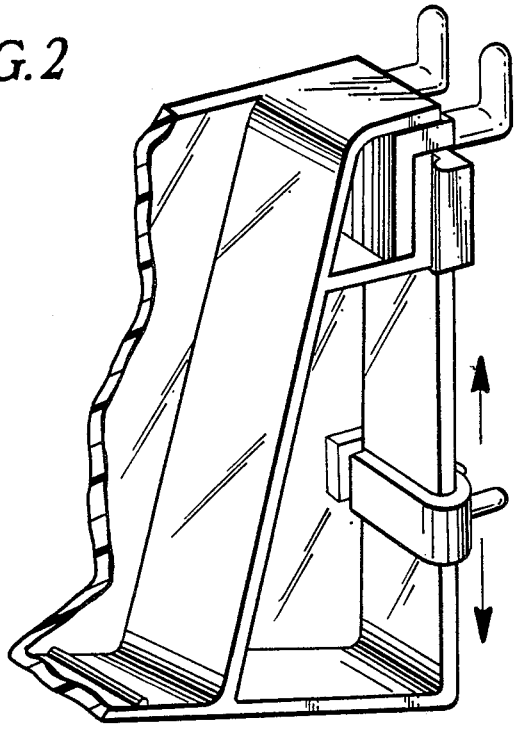
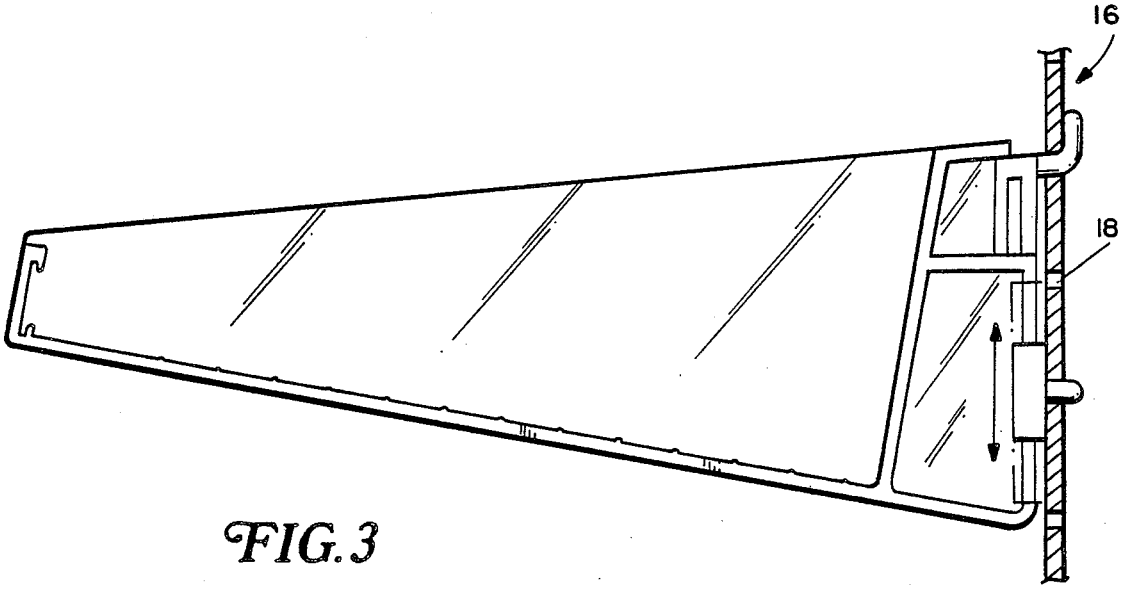
FIG. 3

PEG BOARD DISPLAY BRACKETS

This is a continuation-in-part application of Ser. No. 191,537, filed May 9, 1988 and now U.S. Pat. No. 4,817,900.

The present invention relates to display systems and more particularly to display systems making use of support brackets used in connection with a display panel.

There are many different types of display systems. One makes use of a display panel known in the art as "peg board" which has a matrix of regularly spaced holes. A number of different support brackets are available for use with the peg board, each having one or more L-shaped hooks which when passed through the holes of the peg board, connects the bracket thereto.

A recent introduction into the display system market is the "slot wall" panel which, instead of a matrix of holes, has a plurality of horizontally extending regularly spaced undercut slots. As with the peg board, a number of support brackets are available for use with the slot wall panel, each with an L-sectioned flange to extend into a slot and engage the wall of the panel behind one undercut edge of the slot for connecting the bracket with the slot wall panel.

The applicant's co-pending application No. 191,537 now U.S. Pat. No. 4,817,900 entitled SUPPORT DEVICE FOR USE ON A DISPLAY WALL discloses a particular bracket for use exclusively with a slot wall panel and this application is incorporated herein by reference.

It is the object of the present invention to provide a novel bracket for use with display panels.

Briefly stated the invention involves a bracket for supporting a product on a display panel having a number of regularly spaced passages defined therein, comprising:

a body with a surface to carry said product, said body having a support assembly integrally formed therewith to support said surface in position against said display panel; and a first anchor portion for removable connection with said support assembly and at least one hook element which is dimensioned to engage one of said passages.

Preferred embodiments of the present invention are illustrated in the appended drawings in which:

FIG. 2 is a fragmentary perspective view of the bracket illustrated in FIG. 1;

FIG. 3 is a side-elevation view of the bracket illustrated in FIG. 1 in a mounted arrangement.

Figure 1:
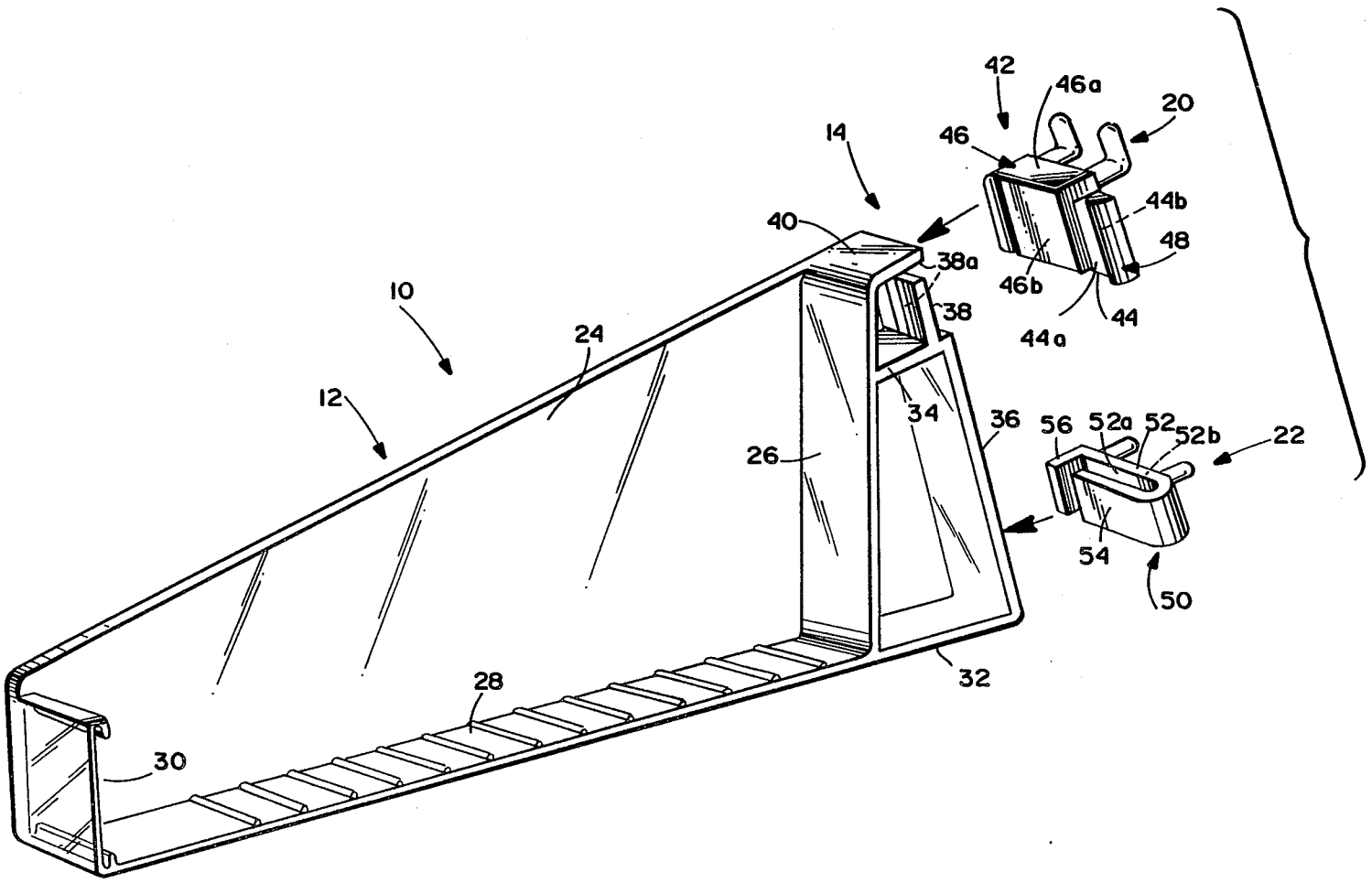
FIG. 1 is a perspective assembly view of a display bracket.

Referring to FIGS. 1 to 3 there is provided a display bracket 10 with a body section 12 to carry a product and a support assembly 14 integrally formed therewith to support the bracket 12 against a peg board display wall panel 16 with a number of holes 18. As will be further described the bracket is also provided with a pair of hooks 20 to extend through a corresponding pair of holes in the panel 16 and a pair of pegs 22 to pass through another corresponding pair of holes in the panel 16 to secure the bracket to the panel.

The body section 12 has a side wall 24, a rear wall 26, a base wall 28 and a front wall 30 which together form a region in which the carried product is located, it being understood that the bracket is intended to be used in connection with another bracket to carry a number of products.

The support assembly 14 has a lower wall portion 32, and an upper wall portion 34, the ends of those portions remote from the rear wall being joined by an upright portion 36. A first flange 38 with an outer face **38*a* projects upwardly from the top surface of upper wall portion 34. A second flange 40 projects rearwardly from the upper edge of rear wall 26. The distal edge of flange 38 is spaced from the adjacent portions of flange 40** for a purpose to described.

An upper anchor clip 42 is associated with the flanges 38, 40 and has a base 44 with an inner face **44*a*, an outer face 44*b* and a pair of side edges (not shown). The pair of hooks 20 project from the outer face 44*b* while an L-shaped hook mounting web 46 projects outwardly from the inner face 44*a*. The hook mounting web has a perpendicular segment 46*a* and a parallel segment 46*b*, both in relation to the inner face. The spacing between the parallel segment 46*b* and the inner face 44*a* of the base 44 equals the thickness of the first flange 38 while the thickness of the perpendicular segment 46*a* is approximately equal to the space between the flanges 38,40**.

A pair of ribs 48 are disposed on the side edges of the base 44 to secure the anchor clip 42 in place once the first flange 38 is disposed between the parallel segment **46*b* and the inner face 44*a* of the base 44**.

A lower anchor clip 50 is provided to engage the upright portion. The lower clip 50 has a base 52 with an inner face **52*a* and an outer face 52*b* and two side edges (not shown). The pegs 22 extend outwardly from the outer face 52*b*. One peg mounting web 54 extends inwardly from one side edge and is folded over the base while another peg mounting web 56 extends from another side edge and perpendicularly outwardly from the base. The ends of the peg mounting webs are spaced to form a gap as will be explained. The distance between the webs 54,56 at the side edges approximately equals the width of the upright portion 36 while the spacing between the web 54 and the inner face 52*a* of the base 52 approximately equals the thickness of the upright portion 36**.

In use, the upper clip 42 is installed on the support assembly by aligning the first flange 38 between one rib 48 and the adjacent edge of the parallel segment **46*b*. Pressure is exerted against the clip 42 to cause the web 46 to flex outwardly as the flange 38 is forced into the space between the parallel segment 46*b* and the inner face 44*a* of the base while a leading rib 48 traverses the outer face 38*a* of the first flange 38. When the clip 42 reaches its assembled position, the leading rib 48 snaps into place adjacent one edge of the flange 38 while the opposite rib 48 is disposed adjacent the opposite edge of the flange 38**.

Similarly, the lower anchor clip 50 is installed on the upright portion 36 by aligning the gap between the webs 54,56 with the thickness of the upright portion 36. The clip 50 is then forced onto the upright portion 36 by flexing the web 54 while the upright portion 36 passes between it and the base 52. The web 56 moves across the outer face of the upright portion 36 until it snaps into position adjacent one edge of the upright portion 36. Once in place, the lower anchor clip 50 may be displaced along the upright portion 36 to enable the distance between the hooks and the pegs to be adjusted as desired.

In its assembled condition, the bracket may be mounted on the peg board by inserting the hooks 20 in a pair of holes 18. The pegs 22 may then be inserted into another pair of holes 18 by pivoting the bracket about the hooks 20.

Figure 4:
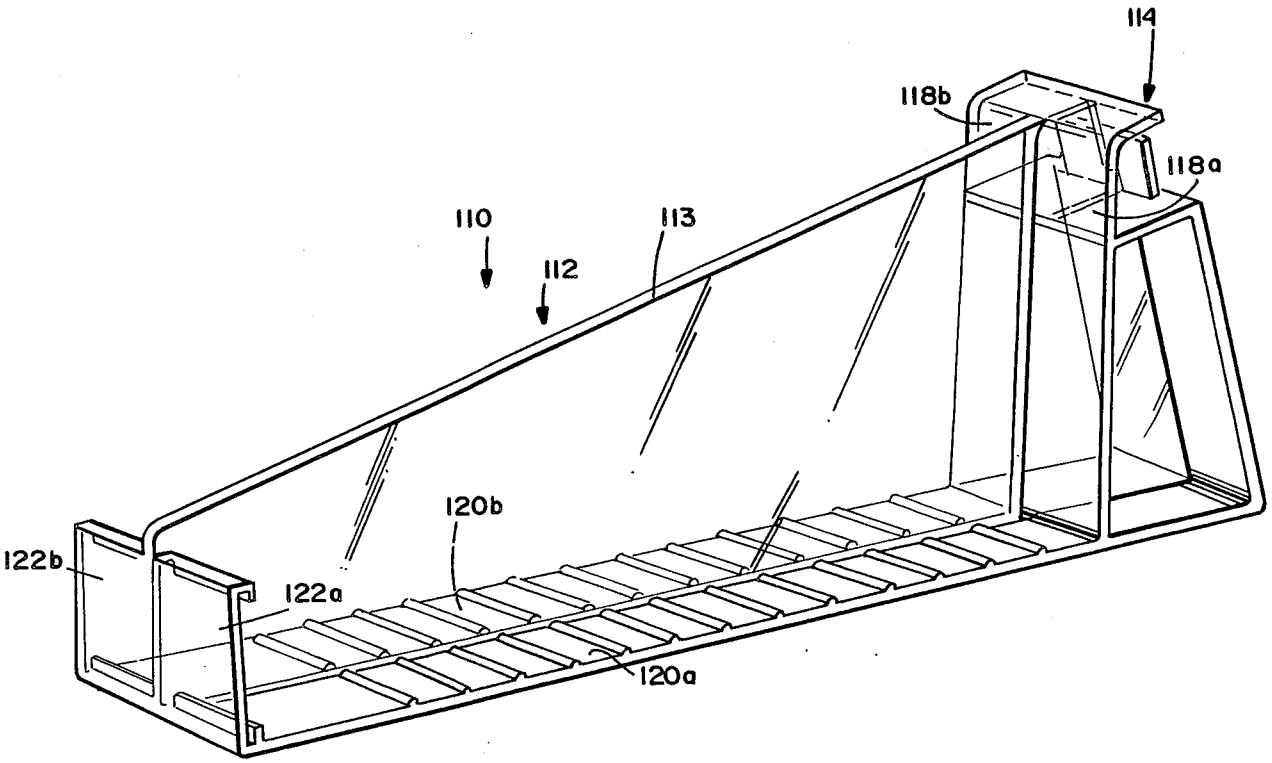
FIG. 4 is a perspective view of another display bracket.

In an alternative embodiment as shown FIG. 4, a bracket 110 has a body portion 112 with a central wall 113 dividing two sets of front, rear and base walls 118*a*,120*a*,122*a* and 118*b*,120*b*,122*b* respectively. In this manner, the bracket 110 may be used to carry two different groups of product when the bracket is used between two other brackets, for example, two brackets 110 or a left and right pair of brackets 10, as will be understood by those skilled in the art. In the case of the bracket 110, a support assembly 114 is provided which is identical to that illustrated at 14 for bracket 10 and for use with the upper and lower anchor clips as described hereinabove. Thus, the support assembly 114 will not be further discussed for the sake of brevity.

Among the numerous advantages provided by the present invention it will be seen that the anchor clips 42,50 and the bracket bodies 12,112 may be injection molded or otherwise fabricated separately, thereby reducing the overall complexity and thus the cost of manufacture of the bracket. Furthermore, the bracket body 12,112 may be made from an inexpensive transparent plastic material while the anchor clips 42,50 may be made from another plastic material which is more durable and flexible, for example nylon.

A further advantage is that the hooks 20 may be dimensioned to fit within the undercut slot area of a slot wall while the pegs 22 may be arranged to fit into an adjacent slot.

It will be understood that the relevant dimensions of the various components of the bracket may be selected depending on the tightness desired between the anchor clips and the support assembly. The hooks and pegs be also made dimensioned according to the desired firmness of the connection between the bracket and the panel. It will be further understood that the term "peg" and "peg element" as used in the disclosure and claims include both flexible and inflexible elements which may be formed in any desired manner to enhance the connection of the bracket to the display panel. For example, the pegs may be resilient and provided with a notch in one side so that, when inserted into either the hole of a peg board panel or a slot of a slot wall panel, the peg will be spring based against the panel to enhance the connection between the bracket and the panel.

If desired, the bracket 10 may also be used without the lower anchor clip.

We claim:

1. A bracket for supporting a product on a display panel having a number of regularly spaced passages defined therein, said bracket comprising:

a body with a surface to carry said product, said body having a support assembly integrally formed therewith to support said surface in position against said display panel;

a first anchor portion for removable connection with said support assembly; said first anchor portion including a base, a pair of hook elements extending outwardly from said base and dimensioned to engage a corresponding pair of said passages; a hook mounting web extending outwardly form said base, said support assembly including a first support flange and a second support flange extending outwardly from said body; said first support flange having an end which is spaced a distance from an adjacent end of said second support flange, said hook mounting web is dimensioned for a sliding engagement between said adjacent ends.

2. A bracket as defined in claim 1 wherein said first support flange has a given thickness, said hook mounting web includes a first segment extending outwardly from said base and terminating at a second segment which is spaced from said base to engage said first support flange, said first segment having a thickness which is approximately equal to the distance between said first and second support flanges and the space between said second segment and said base approximately equal to said given thickness so as to receive said first support flange therebetween.

3. A bracket as defined in claim 2 wherein a said base has a pair of edges, a rib is provided at the each of said edges to lie against a corresponding edge of said first support flange.

4. A bracket for supporting a product on a display panel having a number of regularly spaced passages defined therein, comprising:

a body with a surface to carry said product, said body having a support assembly integrally formed therewith to support said surface in position against said display panel, a first upper anchor portion for removable connection with said support assembly and at least one hook element which is dimensioned to engage one of said passages; and a second lower portion for removable connection with said support assembly and having at least one peg element to engage another of said passages.

5. A bracket as defined in claim 4 wherein said support assembly has support wall, second anchor portion includes a first peg mounting web to engage said support wall.

6. A bracket as defined in claim 5 wherein said second anchor portion has a base, a pair of said peg elements extend outwardly from said base, said first peg mounting web extends from one edge of said base and a second peg mounting web extends from another edge of said base.

7. A bracket as defined in claim 6 wherein said first peg mounting web is folded back on said base so as to engage a face on said support wall, said second mounting web is arranged to engage one edge portion of said support wall.

8. A bracket as defined in claim 4 wherein said second lower anchor portion is adjustable in position on said support assembly relative to said fist anchor portion.

* * * * *